United States Patent [19]

Bordreuil et al.

[11] Patent Number: 4,697,533

[45] Date of Patent: Oct. 6, 1987

[54] DEVICE FOR HOISTING BOATS ON BOARD SHIPS

[75] Inventors: Jacques Bordreuil, Clamart; Michel Lepage, Neuilly sur Marne; André Bordat, Rueil Malmaison, all of France

[73] Assignee: Constructions Mecaniques de Normandie, France

[21] Appl. No.: 755,792

[22] Filed: Jul. 17, 1985

[30] Foreign Application Priority Data

Jul. 17, 1984 [FR] France ..... 84 11309

[51] Int. Cl.[4] ..... B63B 35/44

[52] U.S. Cl. ..... 114/44; 114/48; 114/344

[58] Field of Search ..... 114/44, 48, 258, 259, 114/344, 230, 231, 248, 375, 220, 365, 367, 376; 441/129; 405/1, 3; 294/74, 77

[56] References Cited

U.S. PATENT DOCUMENTS

| | | | |
|---|---|---|---|
| 1,270,903 | 7/1918 | Weismantel | 114/375 |
| 2,896,564 | 7/1959 | Wright | 114/375 |
| 3,191,389 | 6/1965 | Poe | 114/44 |
| 3,303,945 | 2/1967 | Hubbard | 114/375 |
| 3,448,712 | 6/1969 | Lehmann | 114/44 |
| 3,720,967 | 3/1973 | Rice | 114/344 |
| 3,870,256 | 3/1975 | Mazella | 294/77 |
| 4,037,421 | 7/1977 | Whitley | 114/44 |
| 4,204,710 | 5/1980 | Rothaemel | 294/77 |
| 4,242,768 | 1/1981 | Winsett | 114/344 |

FOREIGN PATENT DOCUMENTS

| | | | |
|---|---|---|---|
| 182868 | 3/1963 | Sweden | 114/44 |
| 2086313 | 5/1982 | United Kingdom | 114/375 |

*Primary Examiner*—Jeffrey V. Nase
*Assistant Examiner*—C. T. Bartz
*Attorney, Agent, or Firm*—Larson and Taylor

[57] ABSTRACT

A device is provided for hoisting a boat on board a ship, even when this latter is moving, in which a ramp is provided coupled to the rear of the ship for pivoting about a transverse horizontal axis related to the ship, said ramp being adapted for supporting and smoothly guiding the boat between the water and the reception zone provided on board the ship and being for this purpose formed by an array of cables stretched over a V shaped cradle.

4 Claims, 3 Drawing Figures

DEVICE FOR HOISTING BOATS ON BOARD SHIPS

BACKGROUND OF THE INVENTION

The invention relates to devices for hoisting boats on boards ships and for lowering them into the water from these ships.

It concerns more especially those of these hoisting devices which comprise a ramp coupled to the rear of the ship for pivoting about a horizontal transverse axis related to the ship, which ramp is adapted for supporting the boats between the water and a reception zone provided on board the ship.

In known embodiments of these hoisting devices, the ramp is formed by a solid flat hatch, which has a number of drawbacks and particularly the following:

the drag resistance opposing the advance of the ship when the rear portion of the hatch is immersed in the water is relatively high, so that boat hoisting and lowering operations can only be carried out when the ship is stopped or is advancing at a slow speed, the convex shape of the lower faces of the boat hulls is not suitable for supporting and guiding these hulls by means of solid flat hatches and said faces are damaged when sliding over such hatches, the support in question frequently requires previous upward retraction of the propellers and of their drive motor.

SUMMARY OF THE INVENTION

The purpose of the invention is especially to overcome these different disadvantages allowing such hoisting to be carried out even when the ship is moving at a relatively high speed reaching or even exceeding twenty knots, as is required for hoisting certain boats and motor boats on board sailing in a hostile environment.

To this end, in the hoisting devices of the invention, the ramp is formed by an array of cables stretched over a V-shaped cradle itself formed from longitudinal members extending in the form of a widely open V and horizontal cross pieces tying these members together, the component elements of this cradle likely to be immersed all having a small cross section so that the drag resistance generated by immersion thereof is very low.

In preferred embodiments, recourse is further had to one and/or the other of the following arrangements:

the cradle is divided into two substantially identical half-cradles secured together by tying their portions the furthest away from the cable array, the two half cable-arrays supported respectively by the two above half-cradles are each made from parallel cables and the directions of the cables of these two arrays converge towards the front of the ship, means are provided for automatically using, for the purpose of controlling raising of the ramp, the impact of the front of each boat to be hoisted up against a facing abutment carried by the ship.

The invention comprises, apart from these main arrangements, other arrangements which are used preferably at the same time and which will be more explicitly discussed hereafter.

BRIEF DESCRIPTION OF THE DRAWINGS

In what follows, a preferred embodiment of the invention will be described with reference to the accompanying drawings in a way which is of course in no wise limitative.

DESCRIPTION OF THE PREFERRED EMBODIMENT

Figure 1:
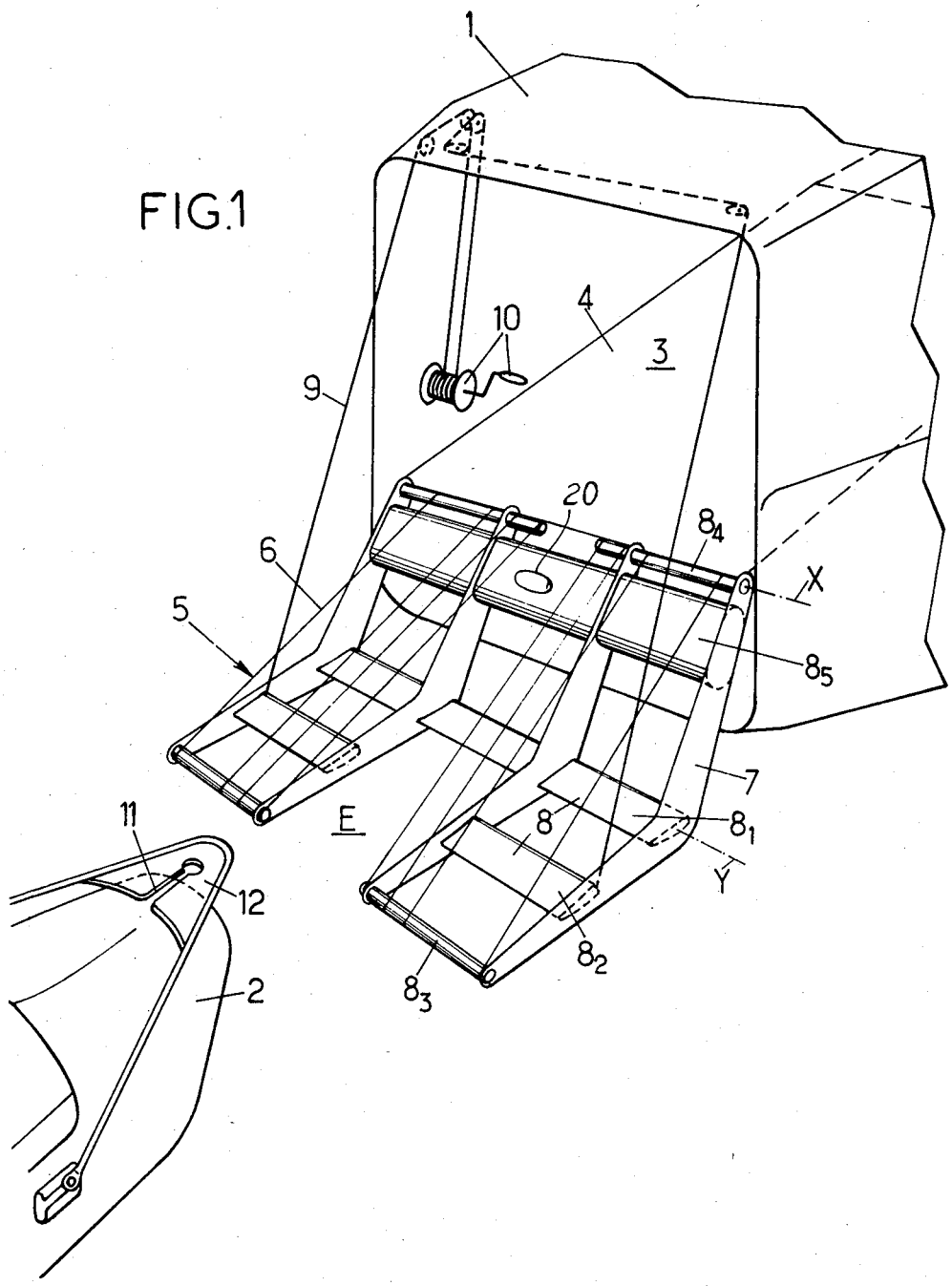
FIG. 1 of these drawings shows a schematical perspective view of a hoisting device constructed in accordance with the invention.

It is proposed to hoist on board a moving ship 1 at least one boat 2 such as a motor-boat.

On the ship is provided a reception dock 3 for the boat, which dock is open at the rear of the ship, and the floor 4 of this dock is extended rearwardly by a towed ramp 5 mounted for pivoting about a transverse horizontal axis X extending substantially in the plane of the rear board of the ship, the rear end of said ramp floating on the water or being immersed in the water to a small depth.

Said ramp 5 is adapted for supporting the boats between the water and the dock and for guiding the advance of these boats by sliding between these two zones without damaging their hulls.

For this, said ramp 5 is formed by an array of cables 6 stretched over a cradle itself formed from longitudinal members 7 tied together by horizontal cross pieces 8.

The portions, of these components 7 and 8, which are immmersed in the water when ramp 5 is in its lowered and towed operating position, each has a small cross section profiled so as to generate a negligeable drag resistance with respect to the energy required for propelling the ship.

Thus, each member 7 can be given the flat shape of a boomerang or a lever bent into a wide V at the level of its bend.

As for the horizontal cross pieces 8, those likely to be immersed are essentially formed by two lift wings or "planes", one $8_1$ situated at the front at the level of the bends of members 7 and the other $8_2$ at the rear situated in the vicinity of the rear end of each member.

Figure 2:
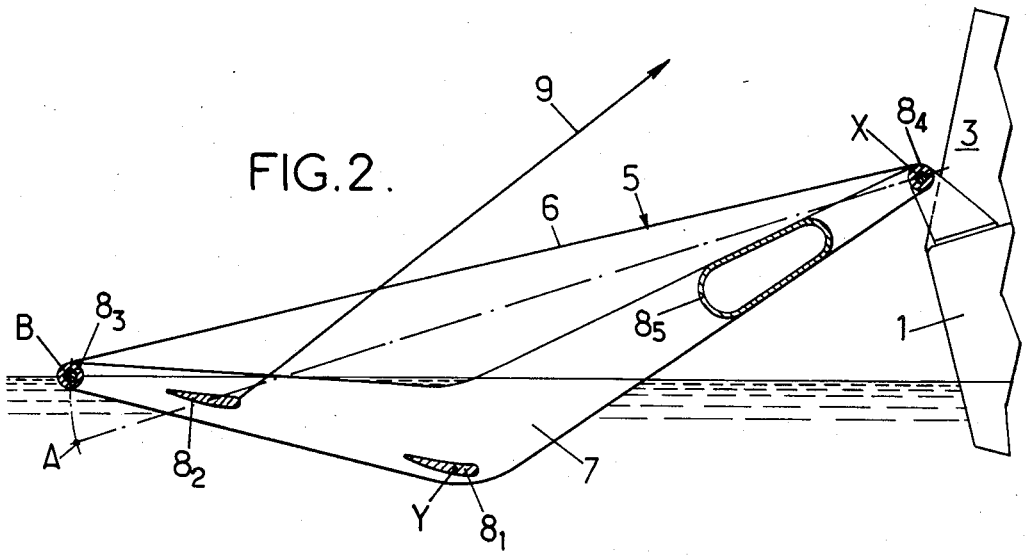
FIGS. 2 and 3 show respectively in vertical section through II—II of FIG 3, and in a top view the essential elements of this hoisting device.
Figure 3:
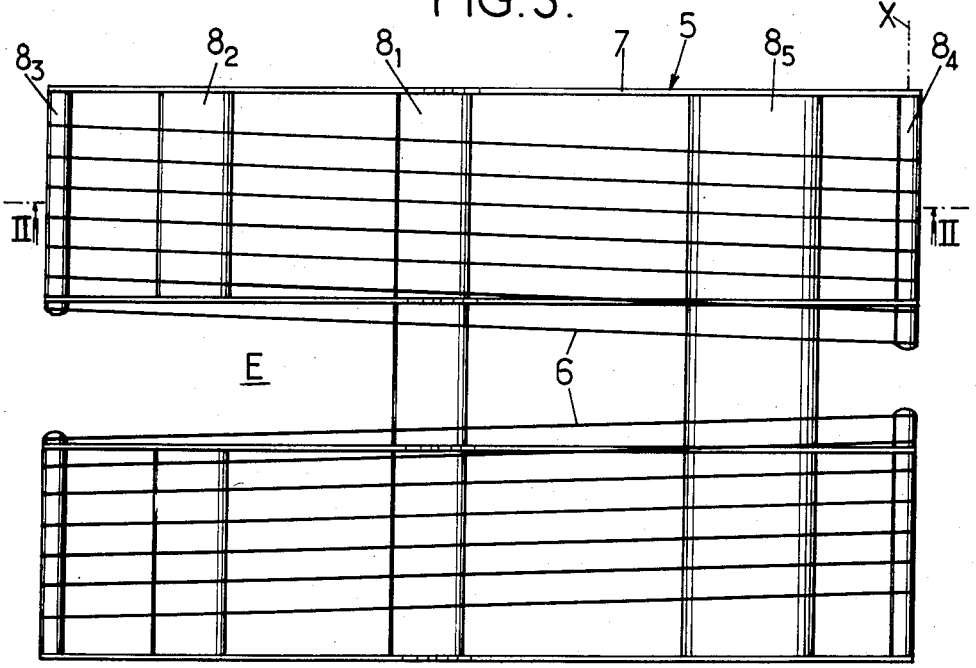

The shapes, dimensions and orientations of the two wings $8_1$, $8_2$ are chosen so that the resultant of the forces exerted by these two wings on the cradle when the ship is moving stabilizes the slope of this cradle with respect to the horizontal and so that, for the maximum speed of this movement, said slope has a value for which the rear end of the cradle remains immersed at a small depth, of the order of a few tens of centimeters on average (point A, FIG. 2). Wing $8_1$—or the front or rear end of this wing, which is the one the most deeply immersed-is preferably mounted for pivoting about a transverse horizontal axis Y, its pivoting resulting in modifying the slope of ramp 5.

The modifications of orientation of wing $8_1$ are controlled from the ship by any desirable mechanism such as a linkage (not shown). An appropriate device shown schematically in FIG. 1 by cables 9 and by a hand winch 10 mounted on the ship serves for raising ramp 5 against the board of the ship outside its periods of use.

In addition to wings $8_1$ and $8_2$, the ties which connect the members 7 together comprise:

a horizontal bend resisting rear bar $8_3$, another horizontal bend resisting upper bar $8_4$ at the front extending along the pivoting axis X of the ramp, and a caisson $8_5$ adjacent this latter bar $8_4$, which caisson has a relatively large section essentially for stiffening the cradle.

Some at least of the different components 8, $8_1$, $8_2$ are themselves formed by hollow caissons of small density so that when the ship is stopped the cradle "floats" on the water at a level close to those which it assumes during movements of the ship, the rear end of this cradle then being substantially at the same level as the water, as shown at B in FIG. 2.

The caissons in question are formed for example from a light alloy or from a resin and glass or carbon fiber based composite.

The array of cables is formed from cables 6 extending parallel to each other between the two bars $8_3$ and $8_4$ and stretched by any appropriate means such as turnbuckles for example (not shown) mounted on the front portions of the cables.

These cables 6 are formed more especially by metal, preferably steel, cores surrounded by a plastic material sheath having good resistance to sea-water and friction, this material being for example one of the following: PTFE, polyethylene, polypropylene or polyvinyl chloride.

The natures, sections, numbers and mutual distances of cables 6 are chosen so as to form a support both flexible and firm for the boats 2 to be hoisted on board and lowered into the water.

The array formed by these cables 6 may be of a single layer and extend in this case without appreciable discontinuity over the whole width of the cradle.

Such a solution may be envisaged when the hulls of the boats 2 do not have an appreciable lower projection such as that formed by a propeller: such boats are for example those with a flat bottom which are propelled by an airscrew or else in which the marine screw is permanently retracted inside a channel or may be retracted at will upwardly, more especially by swinging the propulsion assembly as is the case for certain outboard motors.

The preferred embodiment which has been illustrated in the drawings lends itself further to the hoisting inboard of boats propelled by rear marine propellers projecting slightly under the hull, in the median longitudinal vertical plane of this hull.

In this variant, ramp 5 is divided into two half ramps separated from each other by a free space E adapted for receiving such a propeller.

More precisely, the above-described cradle is formed by two identical half cradles in which only the furthermost portions of cables 6 are secured transversely together.

In such a case, each half cradle is defined laterally by two members 7 bent into a V and only the ties designated above by the references $8_1$ and $8_5$ extend over the whole width of the cradle, that is at the same time over the whole width of each half cradle and therebetween: on the contrary, the three ties designated by the references $8_2$, $8_3$ and $8_4$ extend only over the width of each half cradle and are interrupted therebetween for freeing space E.

The cable array here comprises two half arrays each formed again by an assembly of parallel cables 6.

But here the directions of parallelism of the cables of the two half arrays are not parallel: these two directions converge slightly towards the front of the ship.

Such a convergence has the advantage of automatically providing centering of each boat on the ramp when it comes alongside.

Since it is especially cables 6 the nearest to the ramp which are acted upon for supporting and slidingly guiding the boats, it may be advantageous to tighten these cables closer to the center and/or to form them from materials more resistant to wear and breakage than the others.

The number of cables 6 in each half array is for example of the order of about 10.

In addition to the above-described ramp 5, means are provided for hauling each boat 2 arriving at this ramp or coming close thereto towards the ship and inside the docking area 3.

These means advantageously comprise :

a pole (not shown)ending at its lower end in a ball and suspended resiliently from an appropriate drive member such as an endless cable stretched between two pulleys one of which is a driving pulley, as is well known in the field of ski-tows, and a notch 11 formed in a triangular plate 12 secured to the prow of each boat 2, which notch is adapted for receiving the above ball for securing the boat to the pole.

The operation of the above-described hoisting-in device is the following.

With ship 1 moving forwards at a speed $V_1$ which may be relatively high, it is proposed to hoist a boat 2 on board.

The ramp or "grid" is lowered at the rear of the ship by means 9,10 and is then towed by this latter: as explained above, the slope of this ramp is stabilized then to a value close to that of floating at rest, which value is generally between 10 and 20° with respect to the horizontal.

As soon as boat 2, propelled by its own motor at a speed $V_2$ greater than $V_1$, comes within the vicinity of ramp 5 or comes alongside, the hauling means are hooked on to this boat, in the above-described example, which hooking on is provided by casting the pole and lodging its end ball in the complementary notch of the boat.

With the help of these hauling means, the boat is hoisted on to the ramp, which receives the hull with an easy sliding fit, i.e. without damaging it.

This hull is automatically centered because of the convergence of the two half cable arrays, so that the propeller projecting under this hull is automatically received in the space or channel E reserved between the two half arrays.

After being hauled up, the boat may be completely introduced into the docking area.

In a variant which may be used when the ramp is fairly long, as soon as the largest part of the boat is on this ramp, this latter is raised through an angle sufficient for its rear end to pass beyond the level of the floor 4 of the docking area : the boat may then be finally introduced into this docking space by gravity, or at least partially so.

The handling for lowering a boat into the water calls into play the same operations as above but in the reverse order.

It should be noted that because of the particular forms adopted for the component elements of the cradle, the ship may move backwards without having to raise the ramp, since there is then no risk of its plunging and coming into contact with the propeller of this ship.

In an improvement which may be advantageous for hoisting operations carried out in heavy weather or in a hostile environment, raising of the ramp is controlled automatically as soon as the boat to be hoisted has reached a position sufficiently high on this ramp under its own means, said control then being made dependent on the abutment of the nose of this boat against an appropriate surface 20 of the ship situated for example on the rear vertical face of the central section of caisson $8_5$.

Following which and whatever the embodiment adopted, a device is finally obtained for hoisting boats up from the water and lowering them into the water whose construction, operation and advantages (more especially the simplicity of implementation and the possibility of carrying out hoisting operations even when the carrier ship is moving) follow sufficiently from what has gone before.

As is evident, and as it follows moreover already from what has gone before, the invention is in no wise limited to those of its modes of application and embodiments which have been more especially discussed ; it embraces, on the contrary, all variants thereof, especially :

those where several independent ramps are towed by the same ship, which ramps serve respectively different docking areas on the ship, those where the array of cables forming the carrying surface of the ramp is replaced by another flexible array, especially by the assembly of such an array and a cover stretched thereover and attached to its endmost cables for hoisting in boats resting on the water through the medium of an air cushion.

What is claimed is:

1. In a device for hoisting a boat on board a ship and for placing this boat in the water from this ship, comprising a ramp coupled to the rear of the ship for pivoting about a horizontal transverse axis related to the ship and for extending longitudinally behind the ship, which ramp is adapted for supporting the boat between the water and the reception zone provided on board the ship, said rramp is formed by a longitudinally extending array of non-extensible cables stretched longitudinally, relative to the ship, over a V shaped cradle, said cradle formed from longitudinal members extending in a widely open V, as viewed in a direction parallel to the said transverse axis, and horizontal cross pieces typing these V shaped members together, the component elements of said cradle likely to be immersed all having a small cross section so that the drag resistance generated by their immersion is very small.

2.The hoisting in device as claimed in claim 1, wherein said cradle is longitudinally divided into two substantially identical half cradles secured together by tying together their portions the furthest removed from the array of cables.

3. The hoisting in device as claimed in claim 2, wherein the two half arrays of cables carried respectively by the two half cradles are each formed from parallel cables and the directions of these two arrays converge towards the front of the ship.

4. The hoisting in device as claimed in claim 1, wherein means are provided for automatically using, for the purpose of controlling raising of the ramp, the impact of the front of each boat to be hoisted in against a facing abutment carried by the ship.

* * * * *